US007037408B2

(12) United States Patent
Wilborn et al.

(10) Patent No.: US 7,037,408 B2
(45) Date of Patent: May 2, 2006

(54) SAFE AND AUTOMATIC METHOD FOR PREPARATION OF COKE FOR REMOVAL FROM A COKE VESSEL

(75) Inventors: Dale W. Wilborn, Rolling Hill Estates, CA (US); Christopher I. Fitzgerald, Long Beach, CA (US); Ronald R. DiPadua, Torrance, CA (US); Gary D. Stewart, Lucedale, MS (US)

(73) Assignee: Chevron U.S.A. Inc., San Ramon, CA (US)

( * ) Notice: Subject to any disclaimer, the term of this patent is extended or adjusted under 35 U.S.C. 154(b) by 90 days.

(21) Appl. No.: 10/323,160

(22) Filed: Dec. 18, 2002

(65) Prior Publication Data

US 2004/0118746 A1 Jun. 24, 2004

(51) Int. Cl.
*C10B 43/00* (2006.01)
*C10B 1/00* (2006.01)

(52) U.S. Cl. ..... 201/2; 202/241; 202/242; 202/270

(58) Field of Classification Search ..... 201/2; 202/241, 242, 270
See application file for complete search history.

(56) References Cited

U.S. PATENT DOCUMENTS 4,995,413 A 2/1991 Torres et al.
5,022,799 A 6/1991 Torres et al.
5,092,863 A 3/1992 Schanzlin
5,139,619 A 8/1992 Schoonover
5,259,930 A 11/1993 Barker et al.
5,417,811 A 5/1995 Malsbury
5,785,322 A * 7/1998 Suggs et al. ..... 277/615
6,050,277 A * 4/2000 Purton et al. ..... 134/167 R
6,228,225 B1 5/2001 Meher-Homji

FOREIGN PATENT DOCUMENTS

WO WO 02/072729 A1 9/2002

* cited by examiner

*Primary Examiner*—Glenn Caldarola
*Assistant Examiner*—Alexis Wachtel
(74) *Attorney, Agent, or Firm*—Steven R. Ellinwood; Alan W. Klaassen

(57) ABSTRACT

A safe, efficient and repetitively operable coke vessel decoking system is disclosed. In a preferred embodiment the closed system comprises a coker vessel pressure-tightly sealed to a top head system, which includes a closure housing with a laterally moveable horizontal closure member therein and a cutting head enclosure, which further comprises a drill stem guide, an access door, and a cutting assembly mounted therein. A novel feature of the invention is a steam purge/blocking system whereby steam pressure is maintained in the closure housing during the coking cycle to maintain seal integrity. Personnel safety during decoking operations is greatly enhanced by eliminating dangerous manual tasks associated with the prior art such as unbolting and removing top head devices. The system can be remotely and repetitively operated through numerous coking/decoking cycles without removal of any system element.

9 Claims, 6 Drawing Sheets

SAFE AND AUTOMATIC METHOD FOR PREPARATION OF COKE FOR REMOVAL FROM A COKE VESSEL

FIELD OF THE INVENTION

The present invention relates to the field of hydrocarbon processing and, in particular, to heavy hydrocarbon processing in coke vessels.

BACKGROUND OF THE INVENTION

Many oil refineries recover valuable products from the heavy residual hydrocarbons (commonly referred to as resid or residuum), which remain following initial refining, by a thermal cracking process known as delayed coking. Generally, the delayed coking process involves heating the heavy hydrocarbon feed from a fractionation unit, then pumping the heated heavy feed into a large steel vessel commonly known as a coke drum. The unvaporized portion of the heated heavy feed settles out in the coke vessel where the combined effect of retention time and temperature causes the formation of coke. Vapors from the top of the coke vessel, which typically consist of steam, gas, naphtha and gas oils, are returned to the base of the fractionation unit for further processing into desired light hydrocarbon products. The operating conditions of delayed coking can be quite severe. Normal operating pressures in coke vessels typically range from 25 to about 50 pounds per square inch and the heavy feed input temperature may vary between 800° F. and 1000° F.

Coke vessels are typically large, cylindrical vessels commonly 19 to 30 feet in diameter and two to three times as tall having a top head and a funnel shaped bottom portion fitted with a bottom head and are usually present in pairs so that they can be operated alternately. Coke settles out and accumulates in the vessel until it is filled to a safe margin, at which time the heated feed is switched to the empty "sister" coke vessel. Thus, while one coke vessel is being filled with heated residual oil, the other vessel is being cooled and purged of coke (between 500 and 1200 tons) formed in the vessel during the previous recovery cycle. The full vessel is isolated, steamed to remove hydrocarbon vapors, cooled by filling with water, drained, opened, and the coke is removed. The drums typically operate on a cycle, switching every 12–30 hours.

Coke removal, also known as decoking, begins with a quench step in which steam and then water are introduced into the coke filled vessel to complete the recovery of volatile, light hydrocarbons and to cool the mass of coke. The vessel is then vented to atmospheric pressure. Decoking is accomplished at most plants using a hydraulic system consisting of a drill stem and drill bit that direct high pressure water jets into the coke bed. To cut coke in this manner in conventional systems the top and bottom heads of the vessel must be removed. A rotating combination drill bit, referred to as the cutting tool, is about 18 inches in diameter with several nozzles and is mounted on the lower end of a long hollow drill stem about 6 inches in diameter. The drill bit is lowered into the vessel, on the drill stem, through a flanged opening at the top of the vessel. A "bore hole" is drilled through the coke using the nozzles which are angled approximately 60 degrees down from horizontal and ejects water at pressures in the range of 2600 to 3600 psig. This creates a pilot bore hole from about 3 to 6 feet in diameter for the coke to fall through.

When the initial bore hole is complete, the drill bit is then mechanically switched to at least two (2) horizontal nozzles in preparation for cutting the "cut" hole, which extends to the full drum diameter. The nozzles shoot jets of water horizontally outwards, rotating slowly with the drill rod, and those jets cut the coke into pieces, which fall out the open bottom of the vessel, into a chute that directs the coke to a receiving area. At some plants the hydraulic drill is raised slowly up from the bottom the entire vertical height of the coke mass, at others the drill is lowered from the top through the mass and at still other plants the coke mass is first cut from the bottom cone of the vessel and the remainder is cut from the top of the vessel. In any case, the cut coke falls out the opening at the bottom of the vessel into a coke chute system. The drill rod is then withdrawn out the flanged opening at the top of the vessel. Finally, the top and bottom of the vessel are closed by replacing the head units, flanges or other closure devices employed on the vessel unit. The vessel is then clean and ready for the next filling cycle with the heavy hydrocarbon feed.

The process of removing and replacing the removable top head and bottom units of the vessel cover is called heading and unheading or deheading. It is very dangerous work, with several safety hazards associated with the procedures. There have been fatalities and many serious injuries. There are significant safety hazards from possible exposure to high pressure water jets, steam, hot water, fires and repetitive stress associated with the manual unbolting work necessary with conventional systems. Accordingly, the industry has concentrated most of their technological improvements in the field of coking to minimize the safety hazards associated with unheading procedures. The once manual deheading procedure has evolved into semi-automatic to fully automatic unheading systems to improve the efficiency of the coking process and alleviate the safety concerns with heading and deheading of coker drums.

The deheading systems have primarily focused on the bottom of the coker unit for safety and economical reasons. There are two typical and commonly used methods to move the bottom head out of the way of the falling coke. The first is to completely remove the head from the vessel, perhaps carrying it away from the vessel on a cart. The other way of "removing" the bottom head is to swing it out of the way, as on a hinge or pivot, while the head is still coupled to the vessel as in U.S. Pat. No. 6,264,829. These systems all use a manual or semi-automatic bolting system that must be uncoupled with every decoking cycle.

Coker vessel top deheading systems are similar to the bottom deheading systems for the coker except they are generally smaller in size. Several different types of mechanical top head systems are used. For example, one type of mechanical top unheading system in common use is referred to as a "plate blind" which serves to open and close the coker drum top. It functions to maintain a positive isolation of the drum's interior contents from exposure to the outside atmosphere in the closed position during the coking or feeding part of the coking cycle. In preparation for decoking, the "plate blind" is removed, exposing the drum contents to the atmosphere. To remove coke a second mechanical top head is used to setup the drill assembly and contain the coke particulant, steam, and hot water during drilling and decoking of the coke vessel. After this device is attached, the drum contents are no longer directly exposed to the atmosphere.

Several additional U.S. patents disclose similar systems. U.S. Pat. No. 5,022,799 describes a coker deheading apparatus and methods for alignment and mounting of the drill stem without direct operator contact. The drill stem is provided in the vicinity of the cutting tool, with a drill stem guide carried on a slidably mounted plate. U.S. Pat. No. 5,092,963 describes an automated top head and drill stem guide assembly which is adapted for remotely operated pivotal removal and replacement of a cover unit from the top of a vertically oriented vessel such as a coking drum. The invention includes a flanged connector unit, which is attachable to the flanged vessel top opening, a top head cover device, and an automated drill stem guide device. These elements are each pivotally attachable to the flanged connector unit, which flanged connector unit is attached pressure-tightly to a top flange of the vessel such as with a coking drum. U.S. Pat. No. 5,259,930 discloses an automated top head cover and stem guide assembly adapted for covering a top opening in vertical vessels such as coking drums, and a method for remotely operating the assembly. The top head assembly includes a flanged connector unit attached pressure-tightly to a top flange opening of a coking drum and a top cover device including a cover unit pivotally attached to the flanged connector unit, so that the cover unit can be pivotally lifted and moved aside. A drill stem guide device is also pivotally attached to the top flange unit, so that a drill stem guide unit can be pivotally moved downwardly into place over the top flange unit opening after a drill stem member is inserted into the vessel. U.S. Pat. No. 5,417,811 discloses a closure device adapted for attachment onto the upper head of a coking drum to prevent hot vapors escaping during drum decoking operations. The closure device comprises a cylindrical shaped housing having a rotatable ball valve and horizontal elongated stem provided in its lower portion, and a cover unit including a packing gland provided at the housing upper end. A rotatable cutting tool provided within the housing above the ball valve has a drive rod extending upwardly through the cover unit packing gland. During operations, the ball valve is opened and the drive rod and its attached cutting tool can be extended downwardly through the ball valve cylindrical-shaped opening into the coking drum and rotated, so as to cut and dislodge coke deposited in the drum.

U.S. Pat. No. 6,228,225 discloses a semi automatic coke vessel deheading device. This invention replaces the blind flange or the top of the coker drum with a clamshell assembly. The deheader device generally comprises a frame, a rotatable bridge, a lift assembly, a rotational assembly, and a plurality of actuators for opening each assembly. The deheader device lifts and rotates the blind flange away from the coker drum in order that the clam shell assembly may be attached to the coke drum prior to the coke cutting process. The blind flange and clamshell assembly are attached on opposite ends of the rotating bridge which can be rotated about a vertical axis of the deheader device through and angle up to 180 degrees.

SUMMARY OF THE INVENTION

According to the present invention, a process and apparatus are provided for repetitively producing and removing coke from a delayed coker vessel without unheading the vessel top, wherein the coker vessel has a top portion having an aperture through which coke is prepared for removal, comprising: (a) sealing an aperture closure housing to the top portion of the coker vessel; (b) sealing a cutting head enclosure to the aperture closure housing; (c) inserting a cutting head into said enclosure wherein said cutting head is attached to the distal end of a vertically rotatable shaft; (d) moving a horizontal closure member within the closure housing to open the aperture of the coker vessel top; (e) rotatably lowering the cutting head by means of the shaft through the vessel aperture into and through coke contained in the vessel; (f) injecting a fluid through a plurality of nozzles attached to the cutting head at a pressure sufficient to cut and dislodge coke from the vessel; (g) raising the cutting head to the position of step (c); (h) moving the horizontal closure member within the closure housing to close the aperture to the coker drum; and (i) repeating steps (c) through (h) through successive coking/decoking cycles. In a preferred embodiment of the invention the closure member is power actuated, such as hydraulically, by remote means, thus obviating any need for personnel to be physically present in the vessel top area during decoking operations.

The delayed coker vessel of the present invention comprises a vessel having a top aperture; a top aperture closure housing sealed to the top aperture; a horizontal closure member moveable within said closure housing; a cutting enclosure sealed to the top portion of the closure housing including a blowback/guide ring assembly (referred to as a blowback/cutting guide) attached to the upper portion of the cutting enclosure; and a coke cutting apparatus seated within the cutting enclosure centrally above the top aperture. The combination of the closure housing and moveable horizontal closure member therein is herein termed a closure unit or valve. In one embodiment of the invention the top portion of the coker vessel is designed and fabricated to be directly sealed to the closure unit, whereas in another embodiment, particularly useful for retrofitting existing coker vessels, an upper transition piece herein termed a spool, is interposed between the vessel top and the closure unit and pressure-tightly sealed to both. In either of these two embodiments, a preferred feature is that the closure housing is pressure-tightly sealed to either (a) the coker vessel or (b) the spool piece. Preferably the pressure-tight seals will withstand pressures within the range of about 100 psi to 200 psi, preferably within the range of about 125 psi to about 175 psi and most preferably between about 130 psi to about 160 psi. In addition to the pressure-tight seals mentioned above, there is a pressure-tight seal between the said horizontal closure member and the valve body seat. The valve body is steam pressured to insure positive isolation from the atmosphere during the coking/decoking cycles. The valve body seat design and steam purge prevent leakage of the coker vessel contents during operation thereof at temperature ranges between about 800° F. and 950° F. and the aforementioned pressure ranges.

The present invention substantially reduces or eliminates the dangerous and time consuming procedure of heading and unheading delayed coker vessels, thus rendering the decoking procedure safer for personnel to perform by insulating them from exposure to high pressure water jets, hot coke, high pressure steam, scalding water, mobile heavy equipment and other extreme hazards. Among other factors, the present invention is based on our conception and finding that coke is safely and efficiently removed from a delayed coker vessel by the closed system process described herein, sometimes visualized by us as a "closed-pipe" system, which includes a pressure-tight seal between a closure housing and the coker vessel top aperture similar to the bottom aperture and valve system described in U.S. patent application Ser. No. 10/043527. The vessel top aperture, which opens and closes, preferably includes automatic and remote operation of a closure unit, such as a valve, located at the top of the coker vessel rather than unbolting and removing or swinging away a "plate blind" or "head" as in the prior art. One aspect of enabling the process of the present invention is having a single mechanical "head" system that serves multiple functions such as opening and closing the coker drum, and facilitating penetration of the drilling mechanism into the coker drum without removal of the mechanical head. In prior art, the manual and semi automatic modes of heading and deheading the top of coker drums requires two mechanical heads, one for closing the coker drum to maintain positive process isolation, and one for guiding of the drill assembly into the coker drum.

One preferred embodiment of the present invention is based on our finding that coke removal is efficiently and safely carried out using a permanently attached cutting head enclosure which is pressure-tightly sealed to the top of the closure housing. The cutting head enclosure, which preferably remains attached without removal throughout repetitive coking/decoking cycles, facilitates safe and efficient operation of the coke drilling mechanism by providing a sealed enclosure and maintaining alignment of the mechanism directly above the coker valve aperture and during the coke drilling process. This feature significantly enhances worker protection and safety by isolating the hydraulic cutting head from workers and reducing the time to remove coke from the coker drum by having the coke cutting apparatus in position and ready to start the decoking process, as soon as the coker aperture is opened. Other unique features include a cutting head maintenance access door to enable easy service and maintenance of the coke cutting head apparatus, and a safety shield or blowback prevention device to contain the high pressure cutting water, the hot liquids, coke particulants, steam, and hydrocarbon emissions during the cutting and dislodging of the coke from the coker drum.

Another preferred embodiment of the invention is a method and apparatus for automatically opening and closing a vessel top aperture by means of a closure unit or valve, in lieu of the removable or partially removable head devices described in the prior art, and without the associated safety and efficiency drawbacks discussed above. In a preferred embodiment, which takes the place of the prior art removable closure flanges, spool pieces bolted to a stationary vessel flanges, hinged flanges, carts, carriages and the like, powered devices, which may be controlled automatically, move a closure member within a closure housing between open and closed positions. These powered devices may comprise any powered actuators, including motors, solenoids, or the like, but preferably comprise linear actuators such as hydraulic or pneumatic cylinders with reciprocating piston rods. Such actuators may be mounted on the vessel closure housing or other stationary location to reversibly and repetitively move the closure member from an open to closed position. Preferably the method of the invention does not typically require direct human intervention in proximity to the vessel top to actuate the powered devices, which is preferably accomplished by remote instrumentation means such as an electronic relay system or computer controlled system. The entire process is, thus, done safely and without significant or dangerous physical effort.

Although secondary to the significant safety improvements, the present invention also substantially shortens the time required to complete decoking, without compromise in human safety or effort. The invention also renders the addition of this new closure device onto the hundreds of existing coker vessels to a relatively simple, quick, and inexpensive procedure, as compared to the difficult, expensive, and time consuming requirement of the existing methods and devices of the prior art described above.

DETAILED DESCRIPTION OF THE INVENTION

Figure 1:
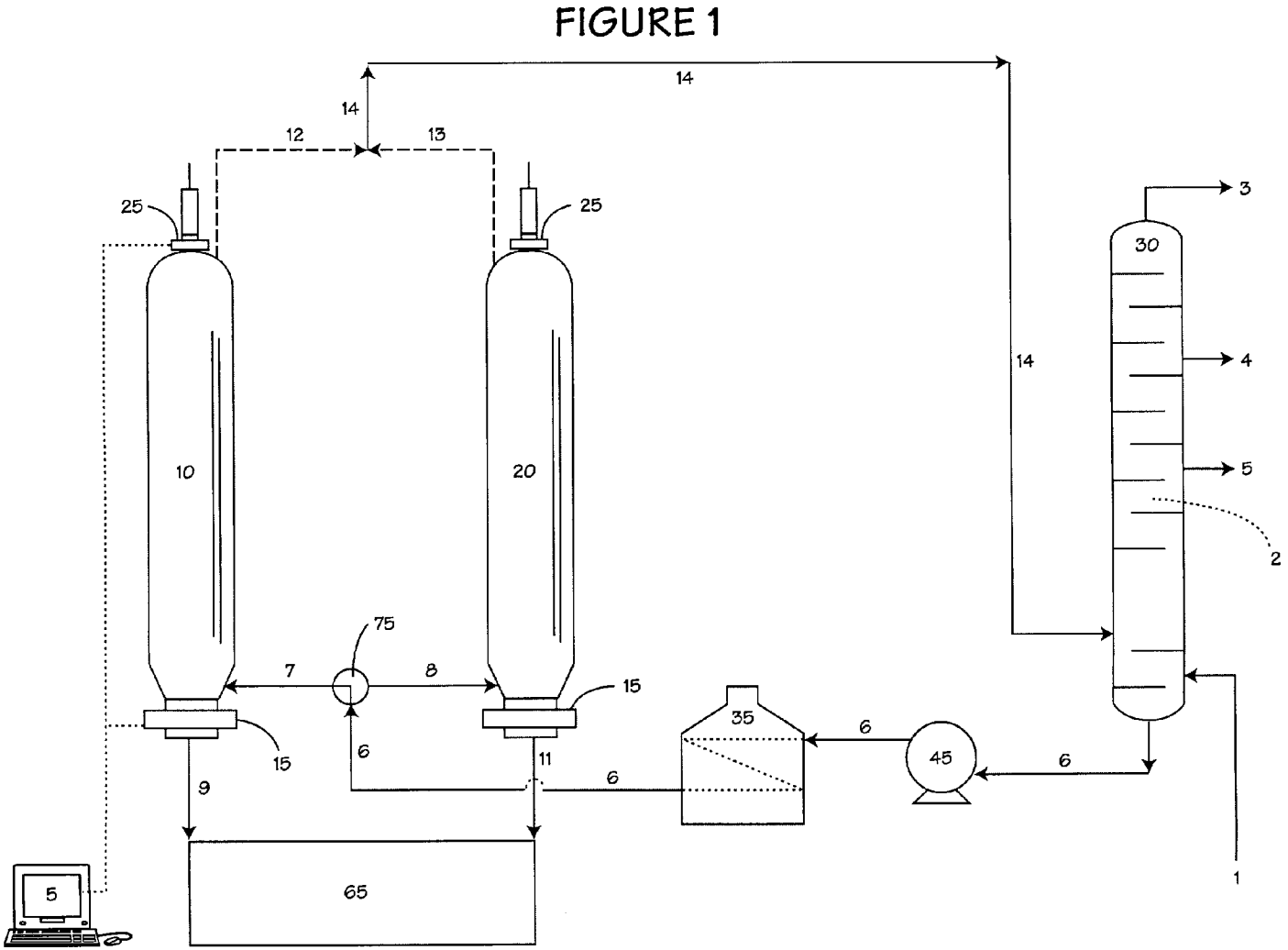
FIG. 1 is a schematic diagram of the delayed coking process of the present invention.

The invention relates to an improved method of repetitively coking heavy hydrocarbons in a coker vessel and repetitively decoking the vessel in a rapid, safe and efficient manner by simply opening and closing a closure member, such as a valve, within a closure unit, rather than removing or swinging away a top head unit, as in prior art. As generally depicted in FIG. 1, delayed coking is accomplished by charging hot, resid oil feed through a feed line 1 to the fractionator 30 above the bottom vapor zone 2. Lighter hydrocarbon materials such as gases, naphtha, diesel and gas oils are separated out in the upper portions of the fractionator vessel and routed through lines 3, 4, 5 and can be routed to other facilities for further refining.

Fresh feed and recycled feed are combined and fed through line 6 from the bottom of the fractionator 30. The combined feed 6 is pumped through pump 30 45 and heated through coke heater 35 to a temperature ranging between about 800° F. to 1000° F., preferably to between 800° F. to 950° F. and, most preferably, to between 850° F. to 950° F., partially vaporized and alternatively charged to one of a pair of coker vessels 10, 20. Hot vapors from lines 12, 13 from the top of the coker vessels 10,20 are recycled to the bottom of the fractionator 30 via line 14.

The reside feed plus internal recycle (not depicted) is routed to the coker vessels 10, 20 via lines 7, 8 through valve 75, commonly called the "switch valve". The unvaporized portion of the coker heater effluent settles out (cokes) in the active coker vessel 10, 20 where the combined effect of temperature and retention time results in coke formation. Coke formation in the coker vessel 10, 20 is continued, typically between about 12 to about 30 hours, until the active vessel 10, 20 is full to within a safe margin from the vessel top.

Once the active coke vessel 10, 20 is full, the heated heavy hydrocarbon feed is redirected to the empty coker vessel 10, 20 where the above described process is repeated. Coke is then removed from the full vessel by first quenching the hot coke with steam and water, then opening a closure unit 25 sealed to the vessel top, hydraulically drilling the coke from the top portion of the vessel, and directing drilled coke from the vessel through a opened coker bottom unit 15 through a attached coke chute to a coke receiving area 65, as disclosed in U.S. patent application Ser. No. 10/043527. Opening of the closure unit 15 and 25 is safely accomplished by a remotely located control unit 5.

Key features of the coking method and coker vessel of this invention include the closure unit 25 with a moveable closure member therein, pressure-tightly sealed to the vessel top 10, 20 including a cutting head enclosure assembly 200 (FIG. 4), which encloses the coke cutting apparatus, positions the coke cutting apparatus centrally above the aperture of the closure unit 25, and maintains constant central alignment of the coke cutting head and shaft assembly it is moved vertically in and out of the coke mass in the coke vessel during the coke cutting process.

Figure 2:
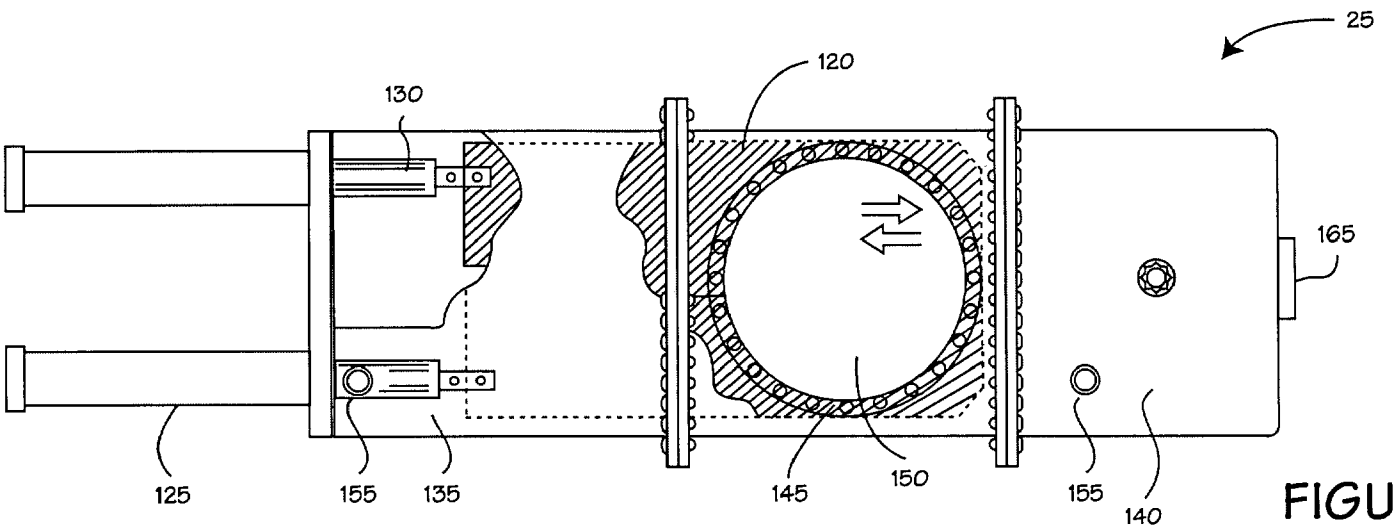
FIGS. 2 and 3 depict top and side views of the coke vessel closure unit with a cut-a-way portion showing the movable closure member within the closure housing.
Figure 3:
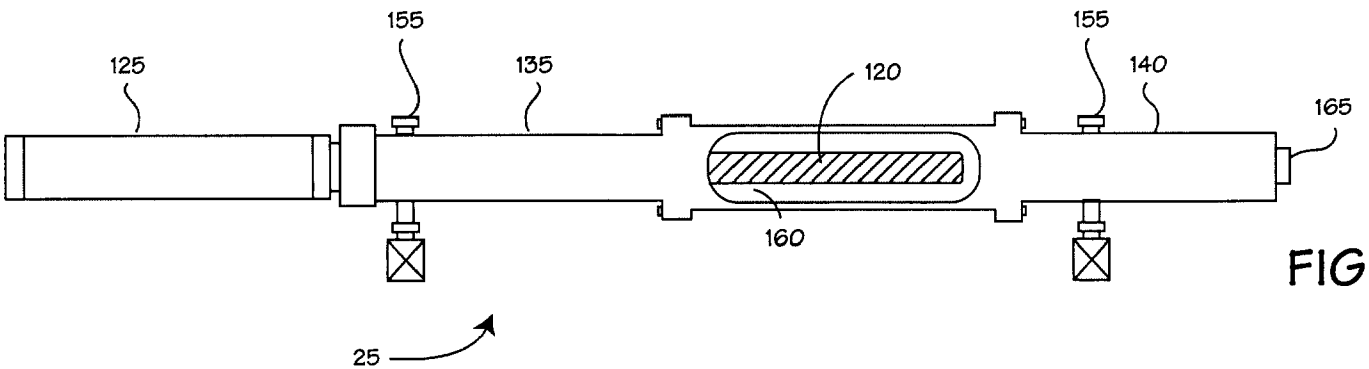

FIGS. 2 and 3 respectively depict plan and side cut-away views of the closure unit of a preferred embodiment of this invention. The closure unit 25 of this invention is a horizontal slide gate, knife, ball, wedge plug or similar type valve comprising a closure housing defining an interior void wherein a closure member 120 is mounted to an electric or hydraulic actuator 130 such that said closure member can be laterally moved to an open or closed position. The closure housing comprises a first end section 135, a second end section 140 and a middle section 145. The middle section defines an aperture 150 that can range in size from 28 to 48 inches in diameter. When moved laterally within the closure housing the closure member 120 opens and closes said aperture 150.

To begin the coking cycle described above the closure member 120 is moved laterally to close the vessel bottom by operating the actuators 125, such as hydraulic cylinders 130 that is, preferably, automatically and remotely operable. When the closure member is moved into the fully closed position the closure housing is purged with steam via inlet lines 155 mounted on the closure housing body 135 and 140. The lockout tower 125 is a special attachment used to interlock the delta valve to prevent mis-operation.

Coking then begins by the process described above. During the coking phase of the coking cycle steam blocking pressure is injected into the closure housing body at a rate sufficient to maintain pressure at a level to effectively eliminate hydrocarbon leaks at the closure member/closure housing seat 160. Blocking steam pressure and flow rate are continuously monitored during the coking phase by use of pressure and flow rate measuring devices. The steam flows into the closure housing 135 and 140 and is monitored by the plant control system (not depicted). High steam pressure can be released through relief valve 165.

Figure 4:
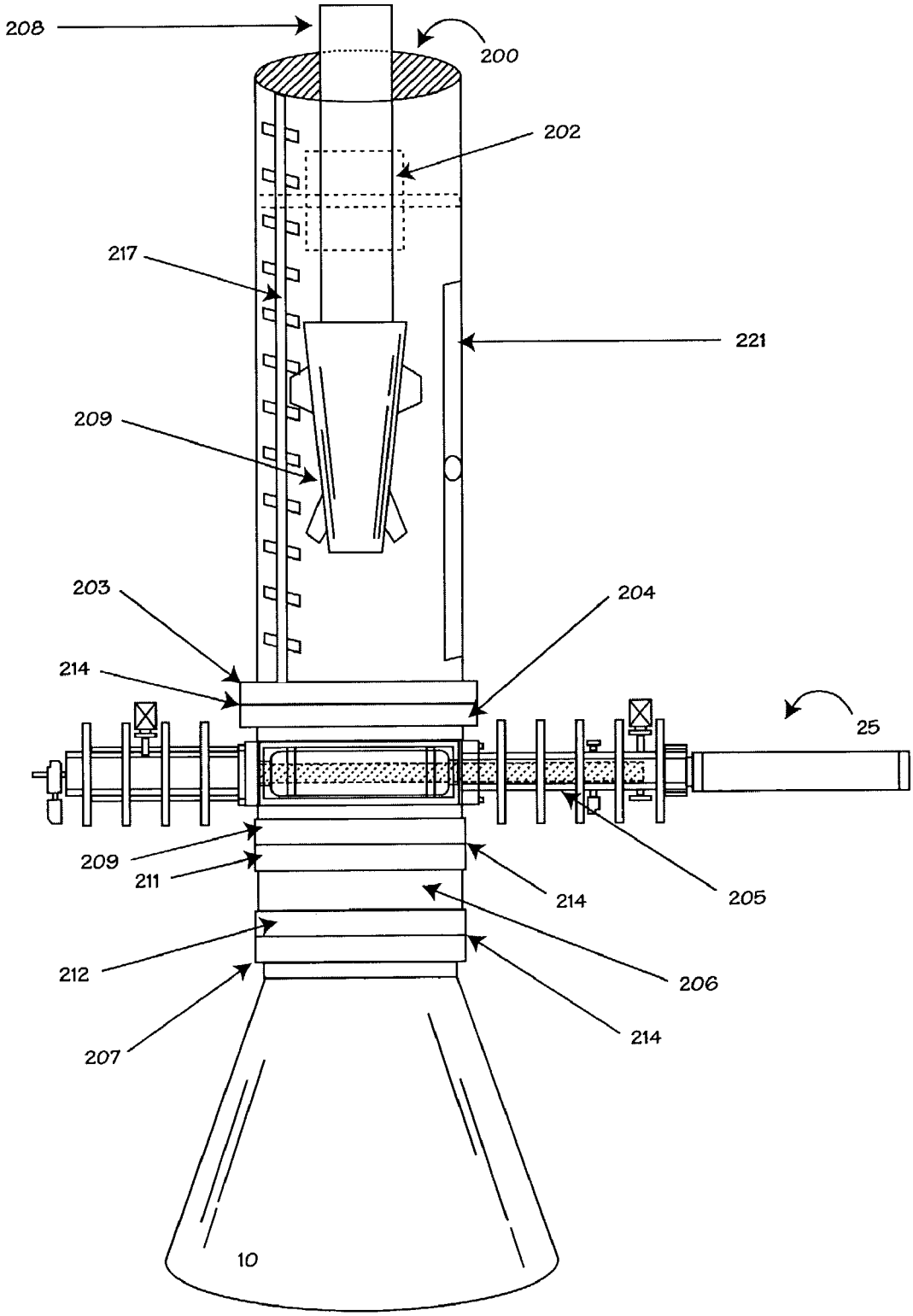
FIG. 4 is a side view depiction of one embodiment of the invention, particularly useful for retrofitting existing coker vessels, showing a spool or transition piece interposed between the coker vessel top and the closure housing and a cutting enclosure attached and sealed to the top of the closure housing including. This side view also depicts the coke cutting apparatus and the blowback/drill guide above the closed aperture of the closure unit during its "rest state".
Figure 5:
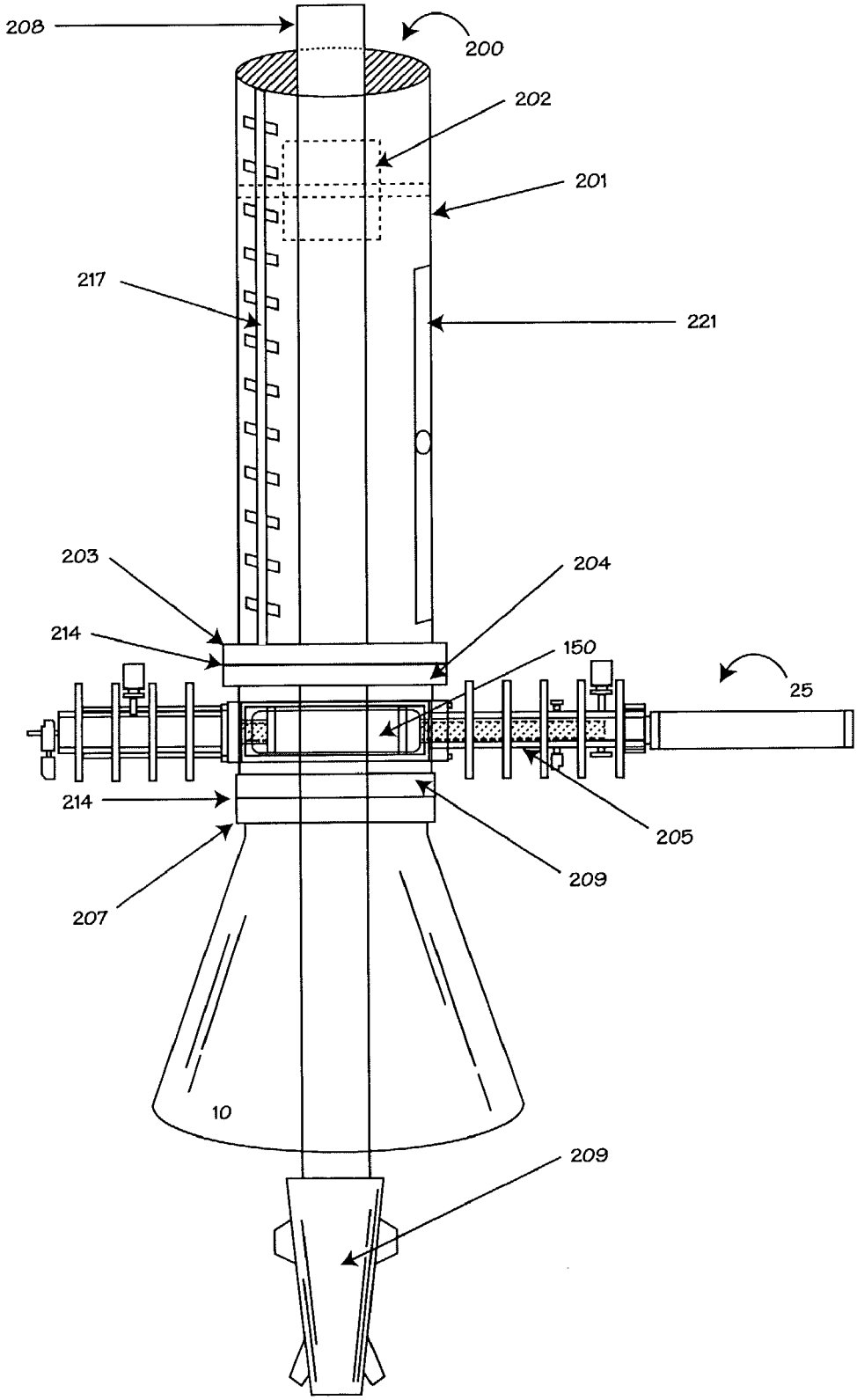
FIG. 5 is a side view depiction of a preferred embodiment of the present invention illustrating the top of a coker vessel designed and fabricated to be directly attached and sealed to the closure housing and a drill enclosure attached and sealed to the top of the closure housing. This side view also depicts the coke cutting apparatus inside the coker drum during the decoking cycle or its "active state".

Referring to FIGS. 4 and 5, said pressure-tight seals are accomplished in one preferred embodiment (FIG. 5) preferably by means of a gasket 214 interposed between facing flanged surfaces of the coke vessel top 207, the closure unit 25 and the coker cutting enclosure 200. In another preferred embodiment (FIG. 4), a spool piece 206 is used to adapt coke vessel top apertures and closure unit 25 apertures of different diameters. In this embodiment said pressure-tight seals are preferably accomplished between facing flanged surfaces of the coke vessel top 207, the spool piece 206, the closure housing, the top valve body flange 204 and the coker drill enclosure flange 203 and the closure unit 25. To form the pressure tight seals between said flanged surfaces preferably the mating surfaces of the respective flanges are machined to a desired finish, then pressure-tightly joined together with a plurality of suitable fasteners, such as bolts, clamps or similar means and with a carefully selected gasket 214 interposed between said mating surfaces. Similarly, to form the pressure tight seals between the flanged surfaces of the closure housing top flange 204 and the flanged surfaces 203 of the cutting head enclosure, preferably the mating surfaces of the respective flanges are machined to a desired finish, then pressure-tightly joined together with a plurality of suitable fasteners, such as bolts, clamps or similar means and with a carefully selected gasket interposed between said mating surfaces. The method for sealing the coker drill enclosure 200 to the closure unit top may be different from the method for sealing the vessel or spool to the closure unit bottom because operating conditions are not a critical factor for seal integrity.

In embodiments of the invention where seal integrity is important throughout repetitive coking cycles, preferably said flanged surfaces are first machined to an RMS (root mean squared) finish ranging from 50 to 400, preferably 100 to 300 and most preferably between about 120 to 130. An annular gasket comprised of a metal core, such as stainless steal, and a flexible material suitable for use as a gasket in combination with metal under temperatures ranging from −50° F. to 1000° F. and pressures ranging from 100 psi to 200 psi is fitted to one of the flanged surfaces of each of the coke vessel top 207, the spool piece 206 and the closure housing 115. With the gasket 214 interposed between each, the coke vessel top 10, and the closure housing 115 (and in another embodiment the spool piece 206) are pressure-tightly joined together by a plurality of suitable fasteners, such as bolts, clamps or similar means. The fastening means, such as bolts, clamps or similar means are tightened or torqued such that the pressure placed on the gaskets ranges between 10,000 PSI to 30,000 PSI, preferably between 15,000 and 25,000 PSI and most preferably 20,000 PSI. Preferably, said torque pressure is applied evenly around the gasket circumference.

In a preferred embodiment of the present invention the metal gasket 214 is annular and stainless steel ranging in thickness from about 0.020 inches to 0.140 inches, preferably about 0.024 inches to about 0.035 inches and most preferably from about 0.028 inches to about 0.032 inches, and is concentrically corrugated. Said corrugations range in height above the metal surface of the gasket from a minimum of about 0.001 inches to a maximum of about 0.050 inches, preferably from a minimum of about 0.005 inches to a maximum of about 0.030 inches and most preferably from a minimum of about 0.010 inches to a maximum of about 0.020 inches. Once corrugated, the width of the gasket is such that the outside and inside diameters thereof are respectively coincident with the outside and inside diameter of the flanged surfaces of the coke vessel bottom, the spool piece, the closure unit and the coke chute. Flexible graphite material, such as Polycarbon flexible graphite Grade B or BP (with antioxidant inhibitor) or Union Carbide flexible graphite grade GTB or GTK (with antioxidant inhibitor), is bonded to the upper and lower surfaces of the gasket metal core such that the gasket is sandwiched between the layers of graphite material. Thickness of the graphite material can range from about 0.005 inches to about 0.030 inches, preferably between 0.010 inches to about 0.025 inches and most preferably is about 0.015 inches thick. Preferably the graphite covering will have the same nominal inside and outside diameter dimensions of the metal gasket. Upon bonding to the gasket metal core surfaces, the corrugations thereof should be covered by the graphite material. Sealing the flanged surfaces of the coker vessel, the spool piece, the closure unit and, optionally, the coker drill enclosure in the manner described above results in a pressure-tight seal that tolerates the differential expansion that occurs between the flanges during the repetitive coking/decoking cycles of the present invention.

FIGS. 4 and 5 depict preferred embodiments of the coker vessel. FIG. 4 depicts the upper portion of a coker vessel 10 which can be 15 to 30 feet in diameter and 80 to 100 feet tall, which is typically cone or funnel shaped on the upper end and which is attached to a top flange 207 that is typically 48 to 30 inches in diameter. A closure unit 25 is pressure-tightly attached or sealed to the upper flange 207. The closure unit 25 has a flanged bottom portion 209, which is pressure-tightly attached or sealed to a coker top flange 207. The closure unit 25 and the cutting head enclosure unit 200 remain sealed in place during repetitive coking and decoking cycles, but can be detached and laterally moved away from the vessel 10 for maintenance via a gantry system, trolley system, rail mounted cart or carriage or other similar system. The number of coking cycle repetitions that can be carried out prior to breakdown of the system for major maintenance can vary from 500 to 5000 cycles per pair of vessels.

FIG. 5 depicts another embodiment of the invention that is particularly suitable for retrofitting existing coker vessels. As in the first embodiment the coke vessel 10 is typically cone or funnel shaped on the upper end which is attached to upper flange 207 that is typically 36 to 48 inches in diameter, preferably 30 to 36 inches in diameter. Interposed between the upper flange 207 and the closure housing 25 is a spool piece 206 having a flanged top and bottom. The spool piece 206, in one embodiment, can be of equal diameter on the top and bottom or, in another embodiment, conical in shape to adapt the coker vessel opening diameter to the closure unit opening diameter, for example a vessel opening of about 48 inches and a closure unit opening of about 30 inches in diameter.

EXAMPLE

In a coking vessel used for delayed coking of heavy petroleum hydrocarbon feed stocks, after about 24 hours of operation sufficient coke is accumulated in the vessel such that removal of the coke is required before coking operations can continue in the vessel. At this point the heated heavy hydrocarbon feed is redirected to an adjoining empty coke vessel. The full coke vessel which is equipped with a lower spool transition piece, a closure unit and attached coke chute operated in accordance with a preferred embodiment of this invention, is shut down, quenched, depressurized and the closure member within the closure housing unit is hydraulically moved laterally to open the coke vessel bottom. Hydraulic movement of the closure member is actuated by workers from a safe, remotely located control system. Important characteristics of the coker vessel of this example, include: a coker top flanged aperture equal to 48 inches in diameter; a flanged spool transition piece wherein the top flange of the spool piece is 30 inches in diameter and the bottom flange is 48 inches in diameter; a closure housing with a 30 inch diameter opening therein; a closure member laterally moveable by hydraulic means within the closure housing; a coker drill enclosure 30 inches in diameter attached to the upper opening of the closure housing; and a 30 inch stroke closure member hydraulic actuator powered by a 3000 psi pump.

Referring again to the coking process steps, upon redirection of the hydrocarbon feed from the full coker vessel to the empty coker vessel, 4000 pounds per hour of steam at 150 psi is injected into the full vessel via the laterally installed inlet line. The steam strips uncoked hydrocarbon from the vessel which is routed to the fractionator. After a period of time, usually about one hour, the vessel is isolated from the fractionator and depressurized through a blowdown system. Stripping steam is thereafter continued for an additional hour and thereafter quench water is added to the vessel at a slow rate to cool the coke bed to approximately 200° F. Upon cooling the vessel to the desired temperature the water is drained from the vessel via the inlet line.

Figure 6:
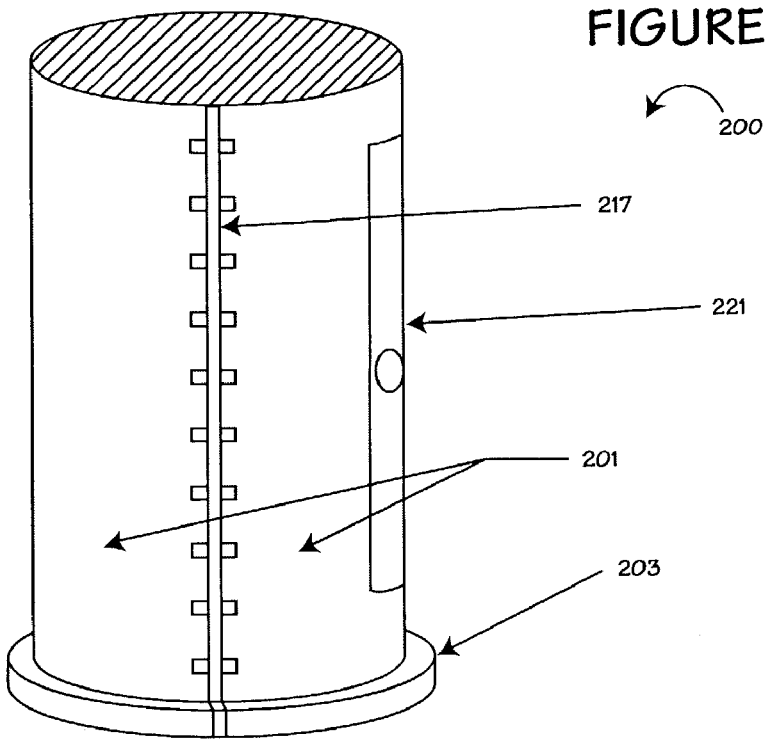
FIGS. 6 and 7 depicts side views showing the outside of the cutting enclosure, which consists of two halves fastened together with one half having a door providing maintenance access to the cutting head inside enclosure and enabling the switching of the service of the cutting head nozzles from boring to cutting. The enclosure ensures that coke particulants, hot liquids, steam, high pressure cutting water, and hydrocarbon gases are contained within the enclosure and vessel.
Figure 7:
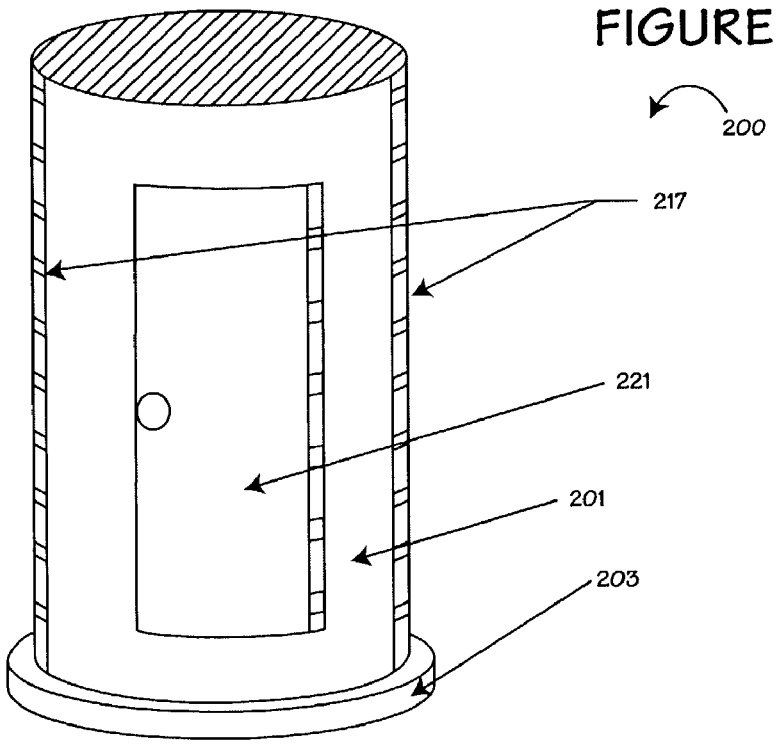
Figure 8:
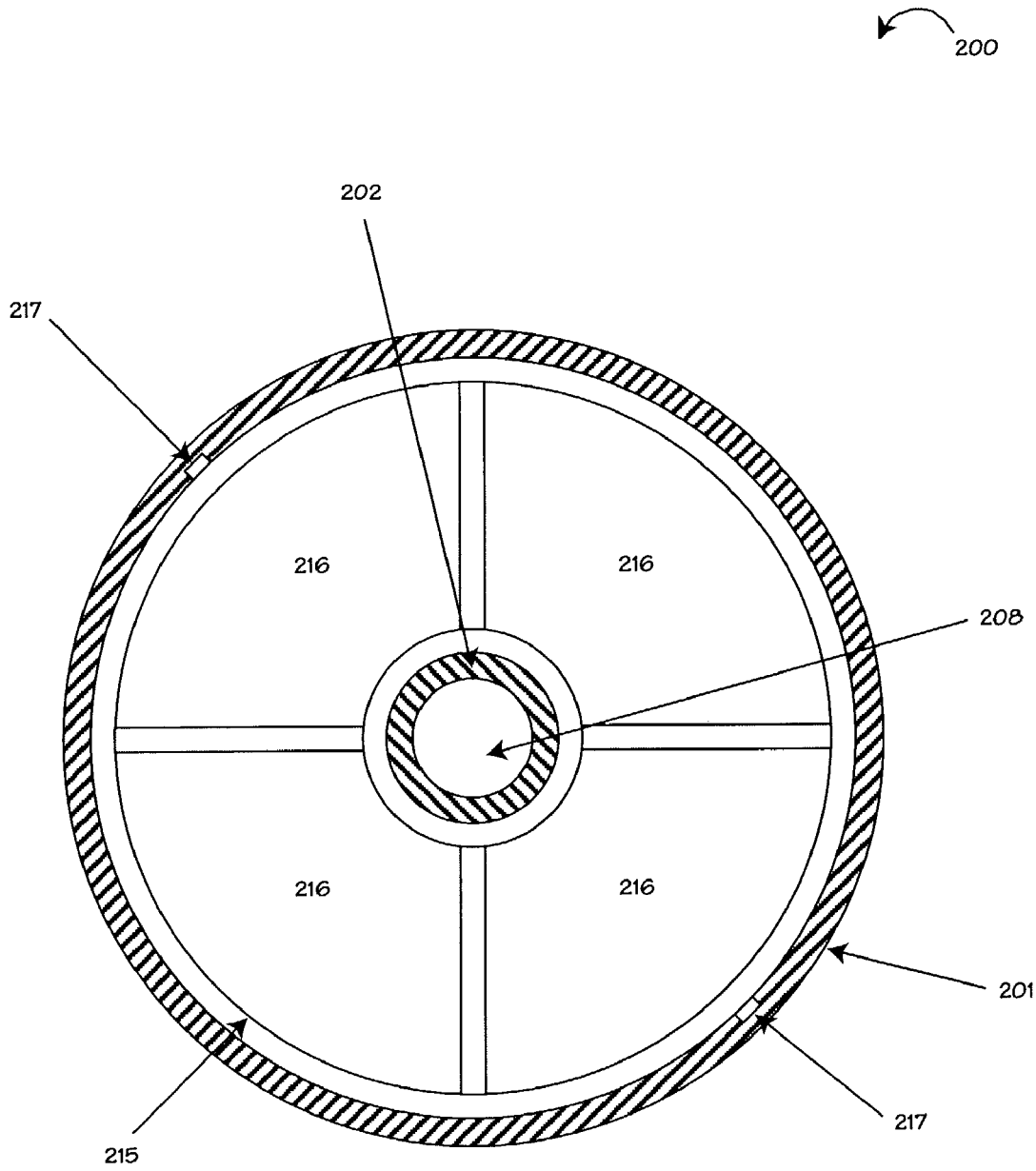
FIG. 8 is a top view of the blowback/drill guide that maintains cutting head central alignment at all times and reduces particulant emissions to the atmosphere during the decoking process.

Once the coke bed is cooled and the water drained, the vessel is prepared for drilling coke from the vessel with the hydraulic drill system. The top closure member within the closure housing is opened hydraulically by remote actuation thereby allowing the drill assembly to enter the top of the coker drum. Coke particulant, hot water, and steam are contained within the vessel, the drill enclosure and the blowback/drill guide assembly (FIG. 8) which is permanently attached to the drill enclosure (FIGS. 6, 7). The blowback/drill guide assembly includes a drill guide that constantly maintains the alignment of the drill shaft centrally above the aperture of the closure unit and within the coker drum during decoking. The drilled coke falls into a coke chute which is attached to the vessel bottom head valve. As the coke is drilled it falls out of the vessel into the coke chute and is directed into the coke pit. Upon completion of the drilling process the hydraulic drill stem is raised vertically, removed from the top of the vessel and brought to rest in the cutting head enclosure. Thereafter, the resid inlet line and coke vessel are visually inspected for plugging. Once the inspection is complete and the removal of coke and absence of plugging is verified, the closure member within the top and bottom closure housings are hydraulically closed. Then steam is injected into the vessel to purge air and pressure the vessel to test the integrity of the head seals, inlet line seals, closure housing/vessel/spool seals, and the closure member seals within the closure housing. Finally, the vessel is preheated to about 400° F. to 600° F. skin temperature. When the desired temperature is reached the resid hydrocarbon feed is switched into this vessel and the adjoining vessel is prepared for decoking in accordance with the above process.

Thus, according to a preferred embodiment of the present invention, a delayed coking method and coke vessel are provided which allow the automatic, safe, quick, and effective opening and closure of coke vessels, or the like. While the invention has been herein shown and described in what is presently conceived to be the most practical and preferred embodiment thereof, many other modifications may be made within the scope of the invention, which scope is to be accorded the broadest interpretation of the appended claims so as to encompass all equivalent structures and methods.

What is claimed is:

1. A process for repetitively producing and removing coke from a delayed coker vessel, wherein the coker vessel has a top portion defining an aperture through which a coke cutting drill is vertically inserted to cut and remove coke from the vessel, comprising:

a) Sealing an aperture closure unit to the top portion of the coker vessel wherein said aperture closure unit comprises a closure housing with a horizontal plate closure member laterally movable therein and a means to maintain a steam blocking pressure therein;

b) Sealing a cutting head enclosure to the aperture closure housing wherein said cutting head enclosure comprises a hollow cylinder having a closable cutting head access portal and a blowback/cutting guide assembly mounted within a top portion of the cylinder;

c) Inserting a cutting head into said enclosure between a top portion of the closure housing and the blowback/cutting guide wherein said cutting head is attached to the distal end of a vertically rotatable shaft extending axially through the blowback/cutting guide;

d) moving a horizontal closure member within the closure housing to open the aperture of the coker vessel top;

e) rotatably lowering the cutting head by means of the shaft through the vessel aperture into and through coke contained in the vessel;

f) injecting a fluid through a plurality of nozzles attached to the cutting head at a pressure sufficient to cut and dislodge coke from the vessel;

g) raising the cutting head to the position of step (c);

h) moving the horizontal closure member within the closure housing to close the aperture to the coker drum; and i) repeating steps (c) through (h) through successive coking/decoking cycles.

2. A process in accordance with claim 1 wherein the horizontal closure member of steps (d) and (h) is a a slide valve, a knife valve or a wedge plug valve.

3. A coker vessel comprising:

(a) A vessel having a flanged top aperture;

(b) An aperture closure unit pressure tightly sealed to said top aperture, wherein said aperture closure unit comprises a closure housing with a horizontal plate closure member laterally movable therein and a means to maintain a steam blocking pressure therein;

(c) A cutting head enclosure assembly sealed to the top portion of the closure unit wherein said cutting head enclosure comprises a cylinder having a closable cutting head access portal and a blowback/cutting guide assembly mounted within a top portion of the cylinder; and (d) A cutting assembly to cut and dislodge the coke.

4. The coker vessel of claim 3 wherein the closure unit comprises a slide valve, a knife valve or a wedge plug valve.

5. The coker vessel of claim 3 wherein the cutting head enclosure assembly accessibly houses a coke cutting apparatus including a portion of a moveable shaft.

6. The coker vessel of claim 4 wherein the valve further comprises a power actuated valve.

7. The coke vessel of claim 5 wherein the moveable shaft extends through the blowback/cutting guide assembly.

8. The coke vessel of claim 5 wherein the moveable shaft is maintained in central alignment with the coke vessel by the blowback/cutting guide assembly.

9. The coke vessel of claim 3 wherein the coke cutting apparatus is selected from the group consisting of hydraulic drill systems, rotating cutting heads with water jets, screw augers, diamond head cutters and water jets.

* * * * *